US005803452A

United States Patent [19]

DeCristoforo

[11] Patent Number: 5,803,452

[45] Date of Patent: Sep. 8, 1998

[54] MARBLE MAZE BOARD GAME

[76] Inventor: John F. DeCristoforo, 13 Day Ave., Brockton, Mass. 02401

[21] Appl. No.: 856,353

[22] Filed: May 14, 1997

[51] Int. Cl.[6] ..... A63F 7/00

[52] U.S. Cl. ..... 273/119 R; 273/123 R

[58] Field of Search ..... 273/118, 119, 273/123

[56] References Cited

U.S. PATENT DOCUMENTS

| | | | |
|---|---|---|---|
| 514,688 | 2/1894 | Starks | 273/118 R |
| 537,605 | 4/1895 | Felt et al. | 273/123 R |
| 538,756 | 5/1895 | Tuttle | 273/118 R |
| 579,198 | 3/1897 | Vick | 273/123 R |
| 801,416 | 10/1905 | Stratton | 273/123 R |
| 970,257 | 9/1910 | McDonald et al. | 273/123 R |
| 1,221,181 | 4/1917 | Hooper | 273/123 R |
| 1,370,171 | 3/1921 | Velasco | 273/118 R |
| 3,315,960 | 4/1967 | Frigo | 273/118 R |
| 3,647,216 | 3/1972 | Breslow | 273/123 R |
| 4,474,374 | 10/1984 | Lewis et al. | 273/123 R X |
| 5,368,300 | 11/1994 | Becker | 273/119 R X |

*Primary Examiner*—Raleigh W. Chiu
*Attorney, Agent, or Firm*—John P. McGonagle

[57] ABSTRACT

A marble maze incorporated into a game board. The present invention playing surface is in the form of a maze of bumpers and railings, and a raised central area with indentations, all providing obstacle paths and capture points for playing marbles. Small, elongated sticks for flicking and moving the marbles are also provided.

9 Claims, 3 Drawing Sheets

MARBLE MAZE BOARD GAME

BACKGROUND OF THE INVENTION

This invention relates to board games, and in particular to a marble maze board game.

Board-oriented marble games are known in the prior art and include: U.S. Pat. Nos. 4,095,793; 3,877,702; and 3,315,960. Marble maze games are also known in the prior art and include U.S. Pat. No. 5,494,292. However, to the best of applicant's knowledge, none of the games in the prior art combine a marble maze with a game board.

SUMMARY OF THE INVENTION

The present invention provides a marble maze incorporated into a game board. The present invention playing surface is in the form of a maze of bumpers and railings, and a raised central area with indentations, all providing obstacle paths and capture points for playing marbles. Small, elongated sticks for flicking and moving the marbles are also provided.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
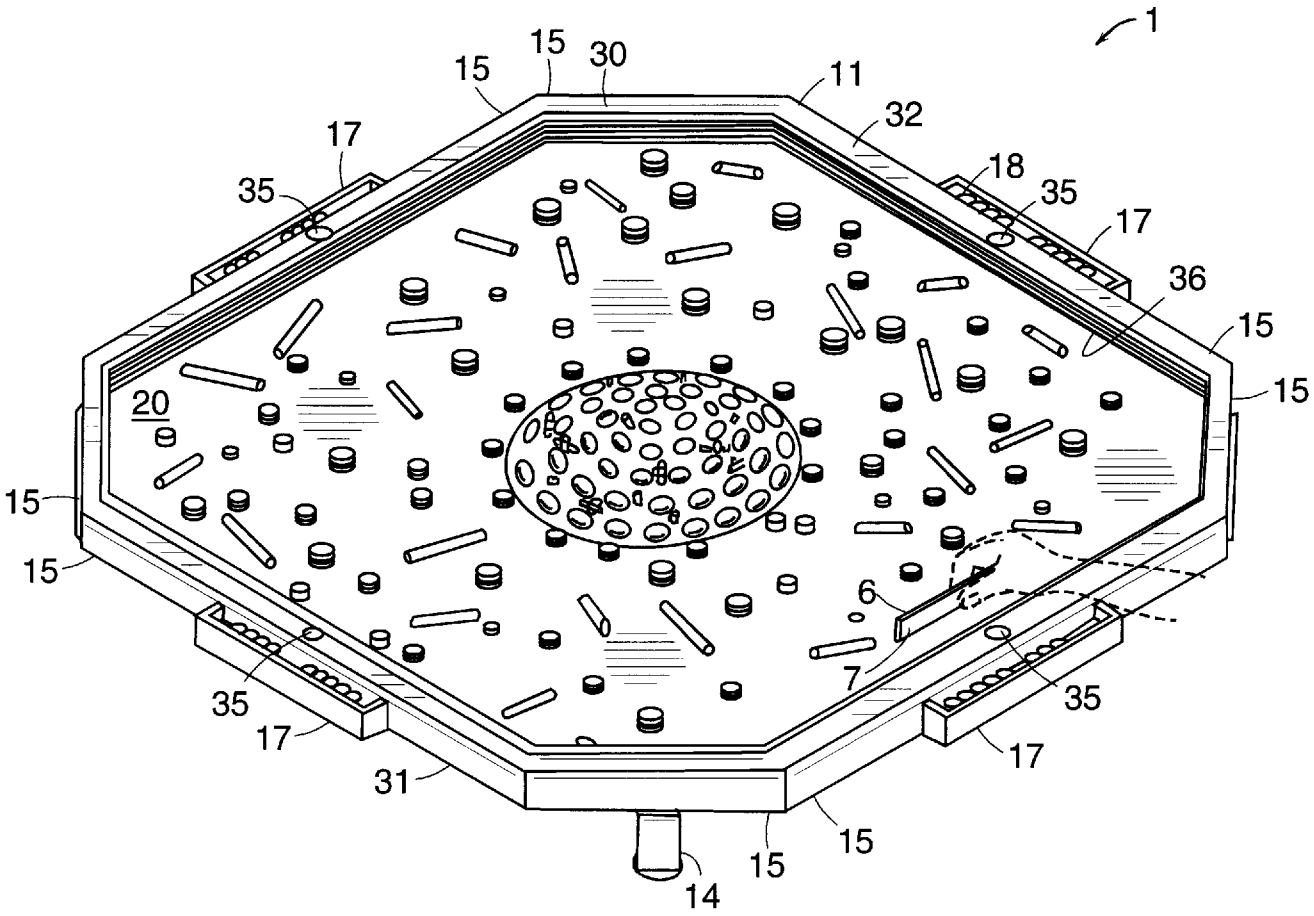
FIG. 1 is a perspective view of a board game constructed according to the principles of the invention.
Figure 2:
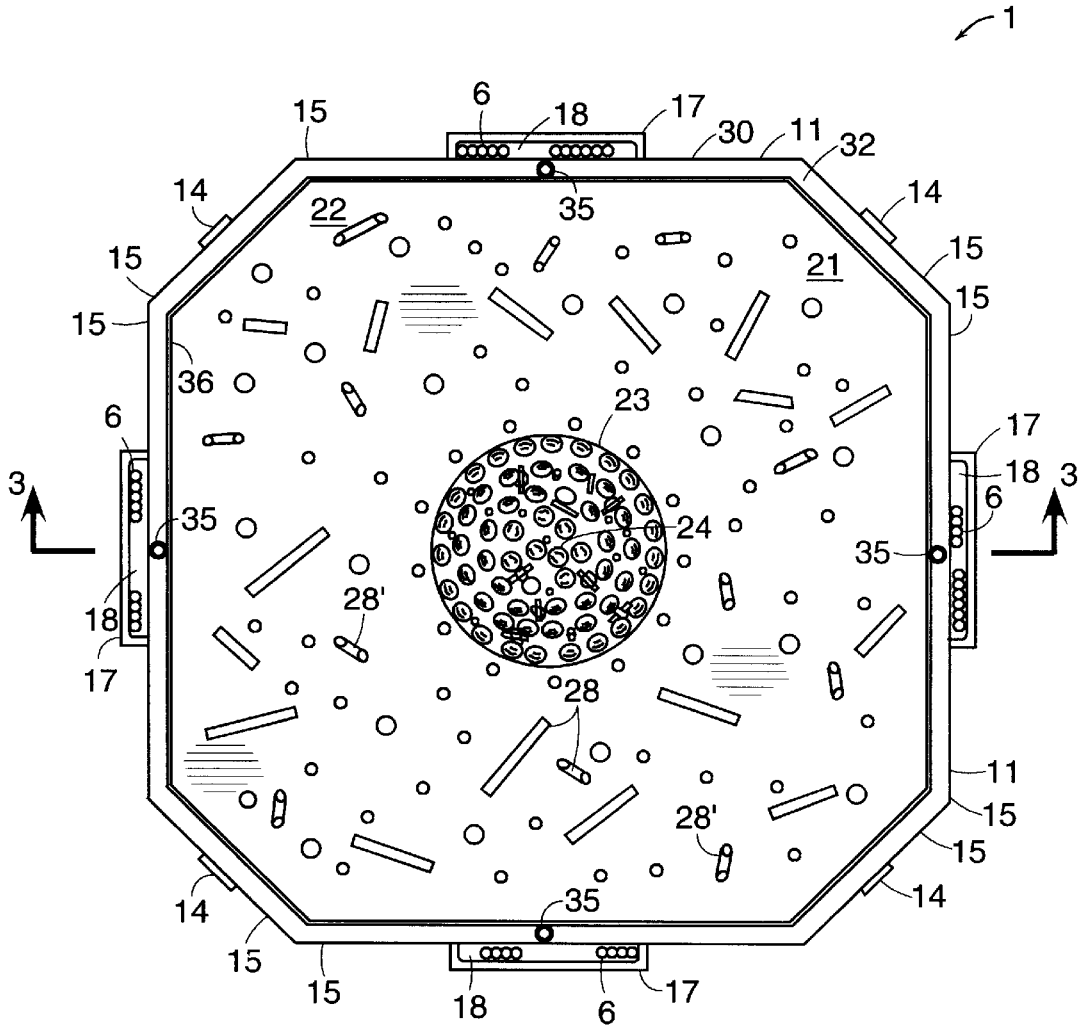
FIG. 2 is a top view of the invention.
Figure 3:
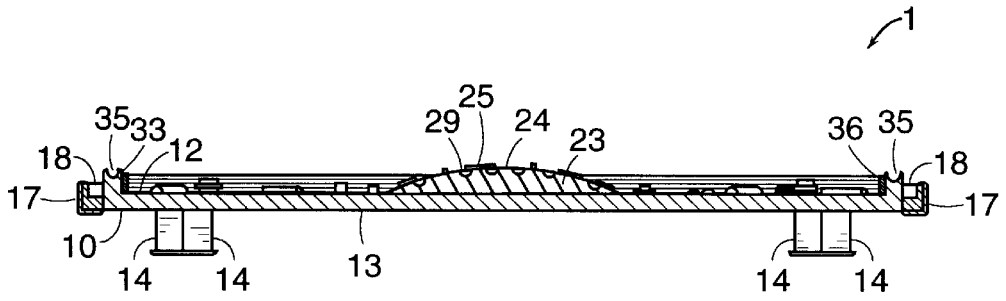
FIG. 3 is a cross sectional view along the line 3—3 of FIG. 2.
Figure 4:
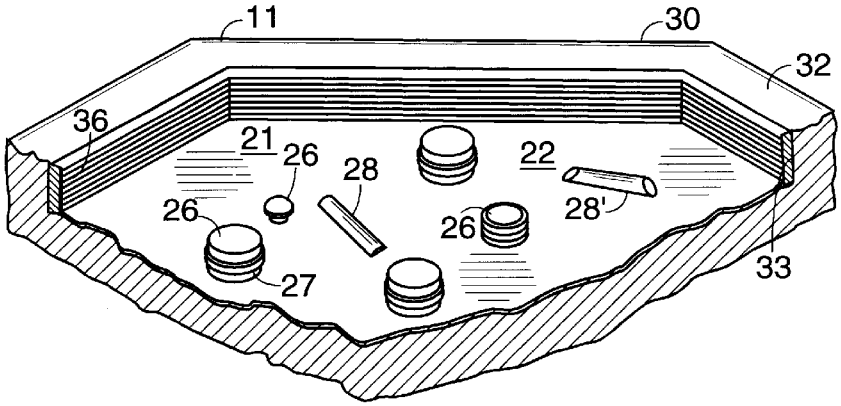
FIG. 4 is an enlarged fragmentary perspective corner view of the invention.
Figure 5:
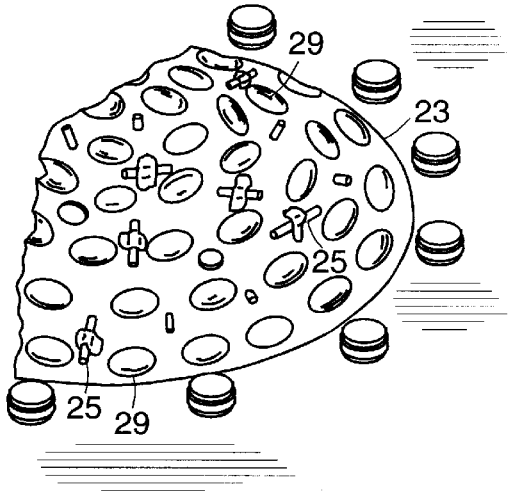
FIG. 5 is an enlarged fragmentary perspective central view of the invention.
Figure 6:
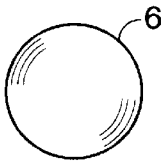
FIG. 6 is an elevational view of a ball used in conjunction with the invention.
Figure 7:
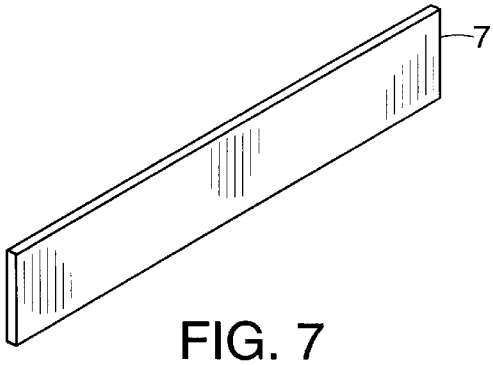
FIG. 7 is a perspective view of an elongated stick used in conjunction with the invention.

Referring to the drawings in detail wherein like elements are indicated by like numerals, there is shown an embodiment of the invention 1 incorporating a marble maze board game. The invention 1 is comprised of a generally flat, octagonal base 10 supporting an octagonal playing surface 20 comprised of an optional solid laminate such as plywood and a cover 22 which may be of billiard felt. Alternatively, the base 10 and playing surface 20 may also be round, rectangular or any other desired shape.

The base 10 has a top surface 12 and a bottom surface 13, said bottom surface 13 resting on and fixedly attached to four pedestals 14. The base 10 has a vertical rim 30 about its periphery 11 forming the eight sides 15 of the base 10, said rim 30 rising vertically up above said base top surface 12 and surrounding the playing surface 20. Four trays 17 are attached to the outside 31 of the rim 30, one tray 17 to every other side 15. Each tray 17 has an elongated, open trough 18 formed therein, said trough 18 having a longitudinal axis parallel to the side 15 to which its tray 17 is attached. Each trough 18 is open vertically upward. The vertical rim 30 has four starting rings 35 formed on its top surface 32. Each starting ring is positioned centrally on the side 15 to which a tray 17 is attached. The rim's interior surface 33, i.e., that part of the rim 30 above and facing the playing surface 20, may have a cushion 36 attached thereto.

The playing surface 20 is flat except for a central, circular area 23 which is gradually raised from the playing surface 20 to a central peak 24. The playing surface flat area 21 has a number of upright cylindrical elements 26 of varying diameters and heights attached thereto. The upright cylindrical elements 26 are usually wrapped with a typically resilient material 27 such as rubber or other elastomer. The playing surface flat area 21 also has a number of elongated cylindrical elements 28 of varying lengths and diameters attached on their sides to the playing surface 20. Some 28' of the elongated elements 28 have trapezoidal longitudinal cross-sections along their longitudinal axis. The central, circular area 23 has a number of apertures 29 formed therein, as well as a number of elongated cylindrical elements 25 of varying lengths attached on their sides to the central, circular area 23 interspersed among the apertures 29.

A player is also provided with a small stick 7 or plastic strip for movement of a ball 6 through the maze of obstacles 26, 28, 25, 29. The ball 6 is typically a "marble" but may be made of any desired material. The resilient material 27 wrapped around the upright cylindrical elements 26 promotes bouncing by the balls 6. The apertures 29 in the central area 23 may be considered part of an obstacle path or have special capture or point allocation or the like attributable to a player having a ball 6 end up in a central area aperture 29. The tray troughs 18 hold balls 6 when not in use on the playing surface 20.

In operation, two to four players will typically play. Each player nominally starts with eleven marbles 6 stored in a tray trough 18. Each player's balls 6 may be of a different color. To start, each player positions a ball 6 on the starting ring 35 adjacent to his tray 17. In turn, each player "shoots" one or more balls onto the playing surface 20. Each player typically shoots by flicking a ball 6 with the stick 7 provided although other techniques for moving a ball can be employed. The obstacles 25, 26, 28, apertures 29, raised central area 23 and rim cushion 36 provide the means for playing a wide variety of "marble" or other games.

It is understood that the above-described embodiment is merely illustrative of the application. Other embodiments may be readily devised by those skilled in the art which will embody the principles of the invention and fall within the spirit and scope thereof.

I claim:

1. A marble maze board game, comprising:

a generally flat, base having a top surface, a bottom surface, and a periphery;

a playing surface supported by said base, said playing surface having a flat area and a central, circular area which is gradually raised from the flat playing surface to a central area peak;

a cover over said playing surface;

a vertical rim about the base periphery forming sides for said base, said rim rising vertically up above said base top surface and surrounding the playing surface, said rim having an inside surface defined as that surface facing said playing surface, an opposite outside surface, and a top surface;

a plurality of upright cylindrical elements of varying diameters and heights attached to said playing surface flat area;

a plurality of elongated cylindrical elements of varying lengths and diameters attached on their sides to the playing surface flat area;

a plurality of apertures formed in said central, circular area;

a plurality of elongated cylindrical elements of varying lengths attached on their sides to the central, circular area and interspersed among the apertures;

a plurality of balls.

2. A board game as recited in claim 1, further comprising:

a resilient material wrapped around said upright cylindrical elements.

3. A board game as recited in claim 2, further comprising:

a cushion attached to the rim inside surface.

4. A board game as recited in claim 3, further comprising:

a plurality of trays attached to the outside of the rim, each said tray having an elongated, open trough formed therein.

5. A board game as recited in claim 4, further comprising:

a plurality of starting rings formed on said rim top surface.

6. A board game as recited in claim 5, wherein:

said cover is made from billiard felt.

7. A board game as recited in claim 6, further comprising:

a small stick adapted for movement of a ball across said playing surface.

8. A board game as recited in claim 7, further comprising:

a plurality of pedestals fixedly attached to said base bottom surface and supporting said base.

9. A board game as recited in claim 8, wherein:

each said ball is a marble.

* * * * *